US005102770A

United States Patent [19]

Baba et al.

[11] Patent Number: 5,102,770

[45] Date of Patent: Apr. 7, 1992

[54] METHOD FOR PRODUCTION OF PHOTOSENSITIVE MATERIAL FOR DIFFUSION TRANSFER PROCESS

[75] Inventors: Susumu Baba; Akio Yoshida; Yasuo Tsubai, all of Nagaokakyo, Japan

[73] Assignee: Mitsubishi Paper Mills Limited, Tokyo, Japan

[21] Appl. No.: 437,619

[22] Filed: Nov. 17, 1989

[30] Foreign Application Priority Data

Jun. 16, 1989 [JP] Japan ..... 1-153788

[51] Int. Cl.[5] ..... G03C 5/54; G03C 1/42/1/74

[52] U.S. Cl. ..... 430/249; 430/230; 430/234; 430/244; 430/566; 430/642; 430/935

[58] Field of Search ..... 430/935, 642, 249, 230, 430/234, 566, 244

[56] References Cited

U.S. PATENT DOCUMENTS

| | | | |
|---|---|---|---|
| 2,269,169 | 1/1942 | Derhoef et al. | 430/935 |
| 2,620,285 | 12/1952 | Rose | 430/935 |
| 3,650,749 | 3/1972 | Willems et al. | 430/249 |
| 3,666,457 | 5/1972 | Youngquist | 430/249 |

FOREIGN PATENT DOCUMENTS 2412098 7/1979 France .

OTHER PUBLICATIONS

*Patent Abstracts of Japan,* vol. 9, No. 199 (P-380)(1922), Aug. 16, 1985, Abstract of Japanese JP-A-6063535.

*Patent Abstracts of Japan,* vol. 14, No. 5 (P-97)(883) Jan. 13, 1982, Abstract of Japanese JP-A-56132,334.

*Primary Examiner*—Richard L. Schilling

*Attorney, Agent, or Firm*—Cushman, Darby & Cushman

[57] ABSTRACT

The present invention provides a method for producing a photosensitive material for silver complex diffusion transfer process containing a hydroxybenzene developing agent which comprises coating at least one gelatin-containing coating solution on a support to form photographic layers including a photosensitive layer and drying the coat, said drying being carried out by raising surface wet-bulb temperature of the coat to 14° C. or higher before gelatin concentration in the coat reaches at most about 30% by weight.

4 Claims, No Drawings

METHOD FOR PRODUCTION OF PHOTOSENSITIVE MATERIAL FOR DIFFUSION TRANSFER PROCESS

BACKGROUND OF THE INVENTION

The present invention relates to a method for producing a material for diffusion transfer process and in particular to a method for producing a photosensitive material for silver complex diffusion transfer process.

In silver complex diffusion transfer process, in general a photosensitive material comprising a support and, provided thereon, a silver halide emulsion layer as a photosensitive layer, an image receiving material comprising a support and an image receiving layer containing physical development nuclei coated thereon and a processing solution containing a solvent for silver halide.

That is, the theory of silver complex diffusion transfer process (hereinafter referred to as "DTR process") is as follows: Silver halide of exposed portion of exposed photosensitive layer is developed with a developing agent in the processing solution or the photosensitive material and simultaneously silver halide of unexposed portion reacts with silver halide solvent to become a soluble silver complex salt, which diffuses into the image receiving material and is deposited at physical development nuclei in the image receiving layer to form a silver image.

The DTR process based on such theory has been widely used for copying of documents such as printed matters, hand written matters, and design drawings and for production of block copies in plate making. Merit of DTR process is that super-high contrast and reproducibility of dots comparable to those obtained by commercially available lith film can be obtained by bringing into close contact a photosensitive material for DTR and an image receiving material in a DTR processing solution using a simple processor and besides maintenance of processing solution is easier than in lith system.

Hitherto, processing solution generally contains a developing agent, but recently for improvement of endurance of processing solution, the developing agent is contained in DTR materials and an alkali activation solution containing no or substantially no developing agent is used.

The present invention also relates to DTR materials which can be processed with such alkali activation solution.

DTR process is superior in that processing is simple as mentioned above, but is unsatisfactory in temperature control of processing solution and is liable to result in change of sensitivity and density. Further, one important property required for photosensitive material used for DTR process is to afford high transfer density in image receiving material. There is a method to increase amount of silver to be coated on photosensitive material for obtaining high transfer density, but this method is not preferred from the points of cost and saving of silver resources.

Hydrophilic binders advantageous for making photosensitive materials include proteins such as lime treated gelatin, acid treated gelatin, gelatin derivatives (such as those disclosed in Japanese Patent Kokoku Nos. 38-854, 39-5514, 40-12237 and 42-26345, U.S. Pat. Nos. 2,525,753, 2,594,293, 2,614,928, 2,763,639, 3,118,766, 3,132,945, 3,186,846, and 3,312,553, and British Patent Nos. 861,414 and 1,033,186), albumin, and casein, cellulose compounds such as carboxymethyl-cellulose and hydroxymethylcellulose, natural polymers such as agar and sodium alginate, and synthetic hydrophilic binders such as polyvinyl alcohol, poly-N-vinylpyrrolidone, polyacrylic acid copolymer, polyacrylamide and partial hydrolyzates of these derivatives. These hydrophilic binders may be used singly or in combination.

In general, photosensitive materials with hydrophilic binder at least a part of which is gelatin are used and normally these photosensitive materials are dried at low temperature in order to form a uniform surface of coat like ordinary photographic photo-sensitive layer, utilizing sol-formation and gelation phenomena of gelatin. As mentioned in Yuji Harazaki, "Coating Engineering", pages 278-281 (1971) published from Asakura Shoten, the drying process is divided into three of a period of preheating of the material, a period of constant-rate drying where evaporation amount of solvent per unit time, namely, evaporation rate of solvent is constant, and a subsequent period of falling-rate drying where evaporation rate of solvent gradually decreases and finally substantially no evaporation occurs (namely, the coat becomes to have substantially equilibrium water content under outer temperature and relative humidity conditions). If necessary, a humidity controlling period may further be provided. Usually, when equilibrium water content has reached about 5-8% by weight, drying is completed, but if temperature of surface of coat during drying (which is referred to as "surface wet-bulb temperature" in this specification) is lowered, uniform coat is obtained. However, according to the above drying method, it was impossible in case of photosensitive material for silver complex diffusion transfer process containing a hydroxybenzene derivative developing agent to obtain high transfer density and to inhibit deflection of sensitivity and density due to variation of temperature during processing.

SUMMARY OF THE INVENTION

An object of the present invention is to provide a photosensitive material for diffusion transfer which can give high transfer density.

Another object of the present invention is to reduce deviation of sensitivity and transfer density caused by variation of temperature in processing.

The inventors have conducted intensive research in an attempt to improve photosensitive materials for diffusion transfer in order to obtain and to reduce deflection of sensitivity and transfer density due to variation of temperature in processing and as a result have found surprising fact that the improvement has close relation with conditions for drying the coat layers of photosensitive material and can be attained by employing the drying condition opposite to the conventional knowledge mentioned above.

The above objects have been attained by a method for producing photosensitive material for silver complex diffusion transfer process which contains a hydroxybenzene developing agent which comprises coating at least one coating solution containing gelatin on a support as photographic layers on photosensitive layer side and drying the coat, characterized in that the drying is carried out by raising surface wet-bulb temperature of the coat to 14° C. or higher before gelatin concentration of the coat reaches at most about 30% by weight.

DESCRIPTION OF THE INVENTION

Content of gelatin in the coating solution is preferably about ½ or higher, more preferably about ⅔ or higher of total hydrophilic binder in the coating solution. In general, the coating solution is preferably an aqueous solution of about 2% by weight—about 10% by weight in concentration of hydrophilic binder. When hydrophilic binder comprises gelatin alone, the coating solution is preferably aqueous solution of about 4% by weight—about 10% by weight.

Coating method of hydrophilic binder layer in production of the photosensitive material of the present invention may be commonly used methods (for example, air knife coating, extrusion coating, curtain coating, etc.).

Coating amount may be changed depending on demand, but preferably is such that amount of hydrophilic binder is about 1 g—about 10 g/m$^2$. The coated hydrophilic binder layer is first cooled and set and then is hot-air dried with gradually raising the temperature and drying is completed when water is substantially not evaporated. Time from coating until completion of drying is 10 minutes or less or 5 minutes or less at present.

It is for the above-mentioned reason that even for such short time drying, raising of drying temperature of gelatin coating layer has been avoided as far as possible.

However, if the coating layer or layers on the photosensitive layer side of photosensitive material for silver salt diffusion transfer process which contains a hydroxybenzene developing agent is dried with keeping the surface wet-bulb temperature at lower than 14° C. until gelatin concentration in the coating layer gradually increases and reaches about 30% by weight or higher during drying step, sufficient transfer density cannot be obtained and deflection of sensitivity and density due to processing temperature is great. Now, it has been found that on the contrary, when drying is completed by raising the surface wet-bulb temperature to 14° C. or higher before gelatin concentration reaches at most about 30% by weight, transfer density becomes higher and deflection of sensitivity and density due to processing temperature decreases. Even if gelatin concentration of the coating layer becomes too high and the surface wet-bulb temperature is increased to 14° C. or higher in the state of completion of drying or in the state close to completion of drying, substantially no effect of the present invention is recognized.

If the surface wet-bulb temperature is raised to 14° C. or higher just after coating, naturally there occurs problems such as flowing of the coating film. Therefore, it is at least necessary that after coating, the coating layer is cooled and set (gelation) and is gradually dried at a surface wet-bulb temperature of lower than 14° C. until no problems in coating occur even if hot air is blown to the coating layer so that the surface wet-bulb temperature reaches 14° C. or higher. The time when the temperature is raised to 14° C. or higher is desirably when gelatin concentration in the coating layer reaches about 12% by weight or higher, preferably about 15% by weight or higher, though it varies depending on composition of the coating layer. The necessary surface wet-bulb temperature also varies depending on composition of the coating layer and the effect of the present invention begins to occur at 14° C. or higher and increases with rising of the temperature, but when it is too high characteristics of photosensitive material may be lost. Thus, the surface wet-bulb temperature is desirably about 35° C. or lower. Preferred range is 23°-30° C. The surface wet-bulb temperature nearly corresponds to wet-bulb temperature in the atmosphere surrounding the surface of the coating layer to be dried.

As hydroxybenzene derivative developing agent used in the present invention, mention may be made of, for example, hydroquinone, methylhydroquinone, chlorohydroquinone, catechol, pyrogallol, p-aminophenol, o-aminophenol, monomethylaminophenol sulfate, p-oxyphenylglycine, and diaminophenol hydrochloride. Addition amount of the developing agent is not critical, but is preferably about 0.3-3 g/m$^2$.

The hydrophilic binder layers of the present invention include an antihalation layer, a silver halide emulsion layer, an interlayer, a protective layer, a peeling layer, etc. These layers may be coated in succession or simultaneously.

The hydroxybenzene developing agent may be contained in any of antihalation layer, silver halide emulsion layer, interlayer, peeling layer, etc. and may also be contained in two or more layers dividedly.

When the hydrophilic binder layers are coated in succession, the present invention can be applied to the coating of coating solution containing hydroxybenzene developing agent and drying the coat.

When the multiple hydrophilic binder layers are simultaneously coated, the present invention is applied in terms of gelatin concentration in all of the simultaneously coated layers.

Support used for the photosensitive material of the present invention can be any supports usually employed.

These supports include, for example, paper, glass, films such as cellulose acetate film, polyvinyl acetal film, polystyrene film, and polyethylene terephthalate film, metallic support coated with paper on both sides, and paper support coated with polyolefin such as polyethylene on one or both sides.

Silver halides used in the present invention may be any ones, for example, silver chloride, silver bromide, silver chlorobromide and these silver halides combined with silver iodide.

Emulsions mainly composed of silver chloride are considered to be preferred for image reproduction from the points of both the chemical development speed and dissolution speed. It is preferred to use silver chloride, silver chlorobromide, silver chloroiodide and silver chloroiodobromide which contain at least 90 mol% of chloride.

Silver halide emulsion may be subjected to spectral sensitization of blue, green and red. Merocyanine dyes, cyanine dyes and other sensitizing dyes may be used.

Furthermore, the silver halide emulsion may be chemically sensitized with various sensitizing agents, for example, sulfur sensitizing agents (such as hypo, thiourea, and gelatin containing unstable sulfur), noble metal sensitizing agents (such as gold chloride, gold thiocyanate, ammonium chloroplatinate, silver nitrate, silver chloride, palladium salts, rhodium salts, iridium salts and ruthenium salts), polyalkylenepolyamine compounds mentioned in U.S. Pat. No. 2,518,698, imino-amino-methanesulfinic acid mentioned in German Patent No. 1,020,864, and reduction sensitizing agents (such as stannous chloride).

The backing layer which is desirably provided on backside of support contains hydrophilic colloid in an amount necessary to keep balance in curling with the photosensitive layer side. The amount depends on total amount of hydrophilic colloid on the photosensitive layer side, etc.

When an antihalation layer containing a black pigment or the like is provided as an undercoat layer of the silver halide emulsion layer, image reproducibility can be improved. When the silver halide emulsion layer is combined with an antihalation undercoat layer containing a white pigment, image reproducibility can be improved. Also when the silver halide emulsion layer is combined with an antihalation undercoat layer in which the black pigment and the white pigment are used in combination, image reproducibility can be improved.

The hydrophilic binder layer of the present invention can be hardened with suitable hardeners. Examples thereof are aldehyde compounds such as formaldehyde and glutaraldehyde, ketone compounds such as diacetyl and cyclopentanedione, compounds having reactive halogen such as bis(2-chloroethylurea)-2-hydroxy-4,6-dichloro-1,3,5 triazine and those disclosed in U.S. Pat. No. 3,288,775, compounds having reactive olefin such as divinylsulfone and those disclosed in U.S. Pat. No. 3,635,718, N-methylol compounds as disclosed in U.S. Pat. No. 2,732,316, isocyanates as disclosed in U.S. Pat. No. 3,103,437, aziridine compounds as disclosed in U.S. Pat. Nos. 3,017,280 and 2,983,611, carbodiimide compounds as disclosed in U.S. Pat. No. 3,100,704, epoxy compounds as disclosed in U.S. Pat. No. 3,091,537, halogencarboxyaldehydes such as mucochloric acid, dioxane derivatives such as dihydroxydioxane and inorganic hardeners such as chrome alum, potash alum and zirconium sulfate. These may be used singly or in combination of two or more.

The hydrophilic binder layer may contain surface active agents, for example, natural surface active agents such as saponin, nonionic surface active agents such as alkylene oxide type, glycerine type, and glycidol type, cationic surface active agents such as higher alkylamines, quaternary ammonium salts, pyridine and other heterocyclic compounds and sulfonium salts, anionic surface active agents having acid groups such as carboxylic acid, sulfonic acid, phosphoric acid, sulfate esters, and phosphate ester, amphoteric surface active agents such as amino acids, aminosulfonic acids, and sulfate esters or phosphate esters of amino alcohol and fluorine type anionic and amphoteric surface active agents containing fluorine.

The constituting elements of the diffusion transfer material of the present invention may further contain various additives as exemplified below.

Antifoggants and stabilizers such as mercapto compounds and tetrazaindene and besides, wetting agents such as wax, polyol compounds, glycerides of higher fatty acids and esters of higher alcohols, mordants such as N-quanylhydrazone compounds, quaternary onium compounds and tertiary amine compounds, antistatic agents such as diacetyl cellulose, styrene-perfluoroalkylene sodium maleate copolymer, and alkali salts of reaction products of styrene-maleic anhydride copolymer with p-aminobenzenesulfonic acid, matting agents such as polymethacrylic acid esters, polystyrene, and colloidal silica, film property modifiers such as acrylic acid esters and various latexes, thickening agents such as styrene-maleic acid copolymer and those disclosed in Japanese Patent Kokoku No. 36-21574, antioxidants, and pH adjustors.

Processing solution used for diffusion transfer process may contain alkaline materials such as sodium hydroxide, potassium hydroxide, lithium hydroxide, and tribasic sodium phosphate; silver halide solvents such as sodium thiosulfate, ammonium thiocyanate, cyclic imide compounds, and thiosalicylic acid; preservatives such as sodium sulfite; thickening agents such as hydroxyethyl cellulose and carboxymethyl cellulose; antifoggants such as potassium bromide and 1-phenyl-5-mercaptotetrazole; development modifiers such as polyoxyalkylene compounds and onium compounds; developing agents such as hydroquinone and 1-phenyl-3-pyrazolidone; and alkanol amines.

However, in the high-alkali processing solution containing developing agent, the developing agent has the defect that the developing agent undergoes oxidation with air to lose activity. This defect can be greatly improved by containing the developing agent in DTR material, namely, in silver halide emulsion layer and/or a hydrophilic colloid layer which are permeable to water.

In case of such diffusion transfer material containing developing agent, alkali activation solution containing no or substantially no developing agent is normally used.

Japanese Patent Kokoku Nos. 39-27568, 47-30856 and 51-43778 can be referred to for DTR process which uses the alkali activation solution.

The present invention also relates to DTR materials processable with such alkali activation solution, but the material can also be favorably processed with DTR processing solution of developer type which contains developing agent.

The present invention is illustrated by the following examples.

EXAMPLE 1

A gelatin layer of 6 g/m$^2$ was provided on one side of a paper support of 110 g/m$^2$ coated with polyethylene on both sides. Another side of the polyethylene coated paper support was coated with the following coating solutions A and B at wet amounts of 50 g/m$^2$ and 20 g/m$^2$ respectively in this order relative to the support and the coats were dried.

| | |
|---|---|
| Coating solution A | |
| Gelatin | 30 g |
| Water | 300 ml |
| Carbon black | 3 g |
| Hydroquinone | 10 g |
| 1-Phenyl-4,4-dimethyl-3-pyrozolidone | 1 g |
| Sodium dodecylbenzenesulfonate (5% aqueous solution) | 20 ml |
| Total | 500 g |
| pH = 4.5 | |
| Coating Solution B | |
| Orthochromatically sensitized silver chlorobromide emulsion (average grain size: 0.35μ; silver bromide: 5 mol %, silver halide: 0.12 mol, gelatin content 15 g) | 150 g |
| 2,4-Dichloro-6-hydroxy-S-triazine sodium salt (5% aqueous solution) | 10 ml |
| Sodium dodecylbenzenesulfonate (5% aqueous solution) | 15 ml |
| Total | 200 g |
| pH = 4.5 | |

Drying was carried out in the following manner. That is, after completion of coating, samples were cooled for 10 minutes to set, then allowed to pass through drying zones where temperature was gradually higher and when about 75% of water had been evaporated, the samples were kept at a surface wet-bulb temperature of 8° C. (sample A), 11° C. (sample B), 14° C. (sample C), and 17° C. (sample D) at maximum dry-bulb temperature of 35° C. and drying was completed under this condition. In this example, drying was conducted as a model and in the actual production, after the surface wet-bulb temperature is raised to 14° C or higher, the drying is carried out with gradually raising the temperature.

These samples were subjected to correct exposure to an original having appropreate black portions by a process camera. These samples were brought into close contact with image receiving films and these were passed through a usual processor having the following diffusion transfer processing solution and were separated from each other after 60 seconds. Processing temperatures was changed as shown in Table 1.

| Diffusion transfer processing solution | |
|---|---|
| Water | 800 ml |
| Sodium tertiary phosphate ($12H_2O$) | 75 g |
| Anhydrous sodium sulfite | 40 g |
| Potassium hydroxide | 5 g |
| Sodium thiosulfate ($5H_2O$) | 20 g |
| Potassium bromide | 1 g |
| 1-Phenyl-5-mercaptotetrazole | 0.1 g |
| Total | 1 liter |

Sensitivity was expressed by correct exposure time (second) and density was expressed by transmission density.

TABLE 1

| | Processing temperature | | | | | |
|---|---|---|---|---|---|---|
| | 18° C. | | 23° C. | | 28° C. | |
| Sample | Exposure (sec) | Density | Exposure (sec) | Density | Exposure (sec) | Density |
| A | 20 | 2.20 | 21 | 2.40 | 23 | 2.65 |
| B | 22 | 2.25 | 23 | 2.30 | 24 | 2.80 |
| C | 24 | 3.60 | 24 | 3.65 | 24 | 3.80 |
| D | 24 | 3.50 | 24 | 3.65 | 24 | 3.70 |

It can be seen from Table 1 that samples C and D which were dried at a surface wet-bulb temperature of 14° C. or higher were higher in transfer density and far less in deflection in transfer density and exposure time due to variation of processing temperature than samples A and B.

COMPARATIVE EXAMPLE

The procedure of Example 1 was carried out changing the drying conditions as follows. That is, samples were cooled for 10 seconds to set and were allowed to pass through drying zones where temperature was gradually higher and when about 90% of water had been evaporated, the samples were kept at a surface wet-bulb temperature of 8° C. (sample A'), 11° C. (sample B'), 14° C. (sample C') and 17° C. (sample D') at maximum dry-bulb temperature of 35° C. and drying was completed under this condition.

The results are shown in Table 2.

TABLE 2

| | Processing temperature | | | | | |
|---|---|---|---|---|---|---|
| | 18° C. | | 23° C. | | 28° C. | |
| Sample | Exposure (sec) | Density | Exposure (sec) | Density | Exposure (sec) | Density |
| A' | 21 | 2.20 | 22 | 2.40 | 24 | 2.55 |

TABLE 2-continued

| | Processing temperature | | | | | |
|---|---|---|---|---|---|---|
| | 18° C. | | 23° C. | | 28° C. | |
| Sample | Exposure (sec) | Density | Exposure (sec) | Density | Exposure (sec) | Density |
| B' | 22 | 2.20 | 22 | 2.30 | 24 | 2.60 |
| C' | 22 | 2.15 | 23 | 2.50 | 24 | 2.60 |
| D' | 22 | 2.20 | 23 | 2.35 | 24 | 2.50 |

From the results of Table 2, it can be seen that samples C' and D' which were dried by raising surface wet-bulb temperature to 14° C. or higher after gelatin concentration reached 30% by weight or higher were not different in transfer density from samples A' and B' and there were no differences in deflection of transfer density and exposure time due to processing temperature and thus no effect was recognized.

EXAMPLE 2

Example 1 was repeated except that the following coating solution C was used in place of coating solution B.

| Coating Solution C | |
|---|---|
| Orthochromatically sensitized silver chloroiodobromide emulsion (average grain size: 0.35μ; silver bromide: 2 mol %, silver iodide: 0.3 mol %, silver halide: 0.12 mol, gelatin content 15 g) | 150 g |
| Hydroquinone | 3 g |
| 2,4-Dichloro-6-hydroxy-S-triazine sodium salt (5% aqueous solution) | 10 ml |
| Sodium dodecylbenzenesulfonate (5% aqueous solution) | 15 ml |
| Total | 200 g |
| pH = 4.5 | |

The results are shown in Table 3.

TABLE 3

| | Processing temperature | | | | | |
|---|---|---|---|---|---|---|
| Surface | 18° C. | | 23° C. | | 28° C. | |
| wet-bulb temperature | Exposure (sec) | Density | Exposure (sec) | Density | Exposure (sec) | Density |
| 8° C. | 18 | 2.40 | 20 | 2.65 | 22 | 2.95 |
| 11° C. | 19 | 2.35 | 21 | 2.55 | 24 | 2.90 |
| 14° C. | 21 | 3.50 | 22 | 3.55 | 22 | 3.60 |
| 17° C. | 21 | 3.50 | 21 | 3.55 | 21 | 3.55 |

From the results of Table 3, it can be seen that samples dried at surface wet-bulb temperature of 14° C. or higher were higher in transfer density and far less in deflection of transfer density and exposure time due to change of processing temperature than the samples dried at 8° C. and 11° C.

EXAMPLE 3

Example 1 was repeated except that catechol was used in place of hydroquinone in coating solution A. The results are shown in Table 4.

TABLE 4

| | Processing temperature | | | | | |
|---|---|---|---|---|---|---|
| Surface | 18° C. | | 23° C. | | 28° C. | |
| wet-bulb temperature | Exposure (sec) | Density | Exposure (sec) | Density | Exposure (sec) | Density |
| 12° C. | 15 | 1.90 | 17 | 2.20 | 21 | 2.50 |
| 14° C. | 16 | 2.70 | 17 | 2.75 | 17 | 2.80 |

TABLE 4-continued

| Surface wet-bulb temperature | Processing temperature 18° C. Exposure (sec) | 18° C. Density | 23° C. Exposure (sec) | 23° C. Density | 28° C. Exposure (sec) | 28° C. Density |
|---|---|---|---|---|---|---|
| 16° C. | 17 | 2.65 | 17 | 2.70 | 17 | 2.68 |

From the results of Table 4, it can be seen that samples dried at surface wet-bulb temperature of 14° C. and 16° C. were higher in transfer density and far less in deflection of transfer density and exposure time due to change of processing temperature than the sample dried at 12° C.

What is claimed is:

1. A diffusion transfer process which comprises processing a photosensitive material containing a hydroxybenzene developing agent in contact with an image receiving material, wherein said diffusion transfer process is accomplished by exposing said photosensitive material and developing said photosensitive material in the presence of a silver halide solvent to form soluble silver complexes which transfer to said image receiving material, and wherein said image receiving material comprises physical development nuclei, and wherein said photosensitive material is obtained by the method of coating at least one gelatin-containing coating solution on a support to form at least one photographic layer including a photosensitive layer and cooling and drying the layer at a surface wet-bulb temperature less than 14° C. until no coating problems occur and then raising the surface wet-bulb temperature of the layer to 14° C. or higher when the gelatin concentration in the layer is at least 12% by weight and before the gelatin concentration in the layer reaches at most about 30% by weight.

2. A diffusion transfer process according to claim 1, wherein the wet-bulb temperature is raised to 14° C. or higher when the gelatin concentration in the layer reaches 15% by weight.

3. A diffusion transfer process according to claim 1, wherein the wet-bulb temperature is raised to a maximum of 35° C.

4. A diffusion transfer process according to claim 3, wherein the wet-bulb temperature is raised to a range of from 23° to 30° C.

* * * * *